US008353353B2

(12) United States Patent
Reaux

(10) Patent No.: US 8,353,353 B2
(45) Date of Patent: Jan. 15, 2013

(54) SURFACE CONTROLLED SUBSURFACE SAFETY VALVE ASSEMBLY WITH PRIMARY AND SECONDARY VALVES

(76) Inventor: James Reaux, Brookshire, TX (US)

( * ) Notice: Subject to any disclaimer, the term of this patent is extended or adjusted under 35 U.S.C. 154(b) by 0 days.

(21) Appl. No.: 12/998,006

(22) PCT Filed: Jul. 7, 2010

(86) PCT No.: PCT/US2010/041164

§ 371 (c)(1),
(2), (4) Date: Mar. 8, 2011

(87) PCT Pub. No.: WO2011/005826

PCT Pub. Date: Jan. 13, 2011

(65) Prior Publication Data

US 2011/0155381 A1 Jun. 30, 2011

Related U.S. Application Data

(60) Provisional application No. 61/224,406, filed on Jul. 9, 2009.

(51) Int. Cl.
*E21B 34/06* (2006.01)

(52) U.S. Cl. ..... 166/373; 166/332.8; 166/331; 166/386

(58) Field of Classification Search ..... 166/319, 166/323, 325, 331, 332.8, 373, 386
See application file for complete search history.

(56) References Cited

U.S. PATENT DOCUMENTS

| | | | | |
|---|---|---|---|---|
| 4,791,991 | A * | 12/1988 | Morris et al. | 166/319 |
| 4,834,183 | A * | 5/1989 | Vinzant et al. | 166/321 |
| 5,636,661 | A * | 6/1997 | Moyes | 137/614.2 |
| 6,015,014 | A * | 1/2000 | Macleod et al. | 166/374 |
| 6,209,663 | B1 * | 4/2001 | Hosie | 175/57 |
| 7,168,492 | B2 * | 1/2007 | Laplante et al. | 166/319 |
| 7,360,600 | B2 * | 4/2008 | MacDougall et al. | 166/332.8 |
| 7,665,529 | B2 * | 2/2010 | Farquhar et al. | 166/374 |
| 7,798,229 | B2 * | 9/2010 | Vick et al. | 166/332.8 |
| 2007/0095546 | A1 * | 5/2007 | Farquhar et al. | 166/386 |
| 2007/0284119 | A1 * | 12/2007 | Jackson et al. | 166/386 |
| 2008/0210431 | A1 * | 9/2008 | Johnson et al. | 166/330 |
| 2011/0155381 | A1 * | 6/2011 | Reaux | 166/334.1 |

* cited by examiner

*Primary Examiner* — Jennifer H Gay
(74) *Attorney, Agent, or Firm* — The Matthews Firm

(57) ABSTRACT

A surface controlled subsurface safety valve assembly includes primary and secondary valves, such as an upper and lower flapper valve. Only one of the valves is in service at a time. In the event that the primary valve is compromised, and therefore leaks, the SCSSV is shifted to position the primary valve out of service and the secondary valve in service. The SCSSV may have more than two flappers, thereby providing multiple secondary valves, with only one valve in operation at any one time.

14 Claims, 4 Drawing Sheets

SURFACE CONTROLLED SUBSURFACE SAFETY VALVE ASSEMBLY WITH PRIMARY AND SECONDARY VALVES

CROSS-REFERENCE TO RELATED APPLICATIONS

This application is a national stage entry of PCT Application No. PCT/US2010/041164, filed Jul. 7, 2010, which claims benefit of US Provisional Application 61/224,406, filed Jul. 9, 2009.

BACKGROUND OF DISCLOSURE

1. Field of the Disclosure

Embodiments disclosed herein generally relate to an apparatus and method for use, and more specifically to valves and valve control apparatus and methods for controlling flow in oil and gas wells.

2. Background Art

In a typical oil and gas well a casing string extends from the ground surface to a ground formation containing hydrocarbons to be produced. A production tubing string extends within the casing string. A packer is provided downhole to prevent flow of hydrocarbon and other fluids in the annulus between the production tubing string and the casing string. A portion of the casing extends below the packer and the bottom of the production tubing string. Fluid flow is typically from the formation through perforations in the portion of the casing below the packer, into the production string, and through the production tubing string to the wellhead. Fluids may be liquid or gaseous state and may include, among other things, oil, gas and water.

Surface control subsurface safety valves ("SCSSV") are used to prevent uncontrolled flow of reservoir fluids through the tubing string. A SCSSV is threadably inserted within the production tubing string and forms a portion of the production tubing string after insertion.

Typically, the SCSSV is positioned at least several hundred feet below the surface of the earth, or in a typical offshore well, several hundred feet below the mudline. A typical SCSSV comprises a single flapper valve that is rotatably disposed within the valve, and rotates downward to an open position, and is fail-safe rotated upwardly by a spring, and thereby closed. Usually, the SCSSV comprises an internal sliding cylindrical sleeve or flow tube that is spring biased in an upward direction. When the flow tube is in its uppermost position, it permits the flapper to rotate (under spring bias) to its closed position, blocking the bore of the flow tube and consequently closing the valve. When the flow tube is forced downward against its spring bias and the spring bias of the flapper (the flow tube maybe moved by hydraulic or electric means, as is known in the art), the flow tube forces the flapper out of the bore of the valve, thereby opening the valve. Reversal of this procedure moves the flow tube upward, out of the way of the flapper, which then rotates back to its closed position. It can be appreciated that any upward fluid flow during this closing process tends to force the flapper into its closed position.

As mentioned above, flow tubes within SCSSV may be controlled hydraulically or electrically from the surface. For hydraulically operated valves, hydraulic pressure is applied down a control line to a fluid chamber in the SCSSV, forcing the flow tube to slide downwards thereby pushing the flapper downwards to open the valve. When hydraulic pressure is removed, the fail-safe closure spring on the flow tube pushes the flow tube back up and exposes the flapper to the flowing fluid, causing the flapper to shut. The flapper will fail-safe shut with no flowing fluid when the sleeve is removed.

Flapper valves are susceptible to failure for various reasons including corrosion, sand, slam closures, debris, wireline cuts, and other downhole operating conditions. In prior art SCSSVs, upon failure of the flapper valve, installation of a secondary valve within the SCSSV may be required. A typical installation of the secondary valve within the SCSSV requires two wireline processes. The first process involves using a wireline tool to lock out the flapper within the SCSSV. The second process involves using a wireline tool to install a secondary valve within the SCSSV.

U.S. Pat. No. 5,293,943 to Williamson, Jr. teaches a downhole, inline well safety shutoff valve having a spring-loaded, normally closed flapper shutoff flapper element that may be opened by a downwardly driven movement of an operator tube coaxially and slidably disposed within the tubing string bore. A rod structure drives the operator tube.

U.S. Pat. No. 7,178,600 to Luke, et al. teaches a downhole deployment valve including fail safe features such as secondary valve members, an upward opening flapper valve or a metering flapper below a sealing valve.

U.S. patent application Ser. No. 11/041,393, Publication No. 2006/0162939 by Vick, Jr. et al. describes a valve system for use in a subterranean well, the valve having multiple closure devices.

It can be appreciated that it would be desirable to have a SCSSV assembly which comprises multiple flapper valves, with only one flapper valve in service at a time, so that in the event the flapper valve in service becomes comprised (i.e., leaks) then another flapper valve can be put in service.

SUMMARY OF DISCLOSURE

Embodiments disclosed herein may provide a surface control subsurface safety valve ("SCSSV") assembly, suitable for use in oil, gas and like wells and operations, that may include an upper flapper valve, at least one lower flapper valve, a flow tube, and a concealment sleeve. Depending upon the particular embodiment of the apparatus, either the upper or lower flapper valve may serve as the "primary" valve, namely the valve that is first operable, with the remaining flapper valve (either lower or upper, depending upon the embodiment) serving as the "secondary" valve.

Within the scope of embodiments disclosed herein, either of the flapper valves may serve as the primary or secondary flapper valve. The SCSSV assembly of the present disclosure may have a first operating mode in which the primary valve is in service, and the secondary valve is out of service; and a second operating mode in which the secondary valve is in service, and the primary valve is out of service.

Other aspects may pertain to an SCSSV assembly that may include more than two (i.e., three or more) flapper valves, in which case the particular flapper valve that is initially in service comprises the primary flapper valve, with the remaining flapper valves may be considered the respective secondary flapper valves.

Embodiments disclosed herein may also pertain to related methods that include moving the concealment sleeve from an initial position wherein the primary valve is operable and the secondary valve is inoperable, to a second position joining the primary and concealment sleeves wherein the secondary valve is operable and the primary valve is inoperable. The flow tube and the concealment sleeve(s) may be initially connected to one another while the primary valve is in service.

In still other embodiments disclosed herein, there may be a SCSSV assembly for use in a tubestring, where the SCSSV assembly may include a primary valve, a secondary valve, wherein in a first operating mode, the primary valve may be movable between a first position and a second position, and the secondary valve may be concealed within a sleeve; and wherein in a second operating mode, the primary valve may be retained in the second position, and the secondary valve may be no longer concealed within the sleeve.

Additional embodiments of the present disclosure may provide for a SCSSV assembly for use in a wellbore. The assembly may include a housing further comprising a bore, an upper end, and a lower end, wherein each of the ends may be configured for coupling to a tubing string. In addition, the assembly may also include a flow tube slidably disposed in the bore, wherein the flow tube may be movable between an upper position and a lower position, and wherein the flow tube is configured with a bias mechanism to bias the flow tube to the upper position. The SCSSV may also include a sleeve also disposed in the bore.

In other embodiments, the SCSSV assembly may include an upper flapper movably disposed in the housing, the upper flapper movable between a first closed position within the bore, and a first open position out of the bore and into an upper recess disposed in the housing, wherein the upper flapper may be biased to the first closed position. There may also be a lower flapper movably disposed in the housing, the lower flapper movable between a second closed position within the bore, and a second open position that comprises the lower flapper moved out of the bore and into a lower recess disposed in the housing. The lower flapper may be biased to the second closed position. Finally, the SCSSV may include a coupler configured to connectively engage the flow tube and the sleeve together, The SCSSV may be associated with various operating modes, such as a first operating mode whereby the flow tube is disengaged with the sleeve, the sleeve configured to hold the lower flapper in the second open position, and the first operating mode comprises the flow tube in the lower position whereby the lower position flow tube retains the upper flapper in the first open position. There may also be a second operating mode whereby the flow tube is engaged with the sleeve, wherein the upper flapper is retained in the first open position, and the engaged flow tube and sleeve are slidably movable between an engaged upper position whereby the lower flapper moves to the first closed position, and a lower engaged position whereby the flow tube and sleeve hold the lower flapper in the second open position.

Further embodiments disclosed herein may provide for a SCSSV assembly for use in a well that may include a cylindrical housing having a longitudinal bore, an upper end, and a lower end, wherein each of the ends are configured to engage to a tubing string. The assembly may include a flow tube and a retainer sleeve disposed in the longitudinal bore, wherein the flow tube may be configured with a bias toward an upper position, and wherein the flow tube may be slidably movable within the SCSSV.

The SCSSV may also include an upper flapper pivotably disposed in the housing, and pivotable between a first closed position whereby the upper flapper blocks fluid flow upwardly through the bore, and a first open position whereby the upper flapper device may be pivoted out of the bore and into an upper recess of the housing, wherein the upper flapper may be biased toward the first closed position. In addition, there may be a lower flapper pivotably disposed in the housing, and pivotable between a second closed position whereby the lower flapper device blocks fluid flow upwardly through the bore, and a second closed position whereby the lower flapper may be pivoted out of the bore and into a lower recess of the housing, wherein the lower flapper is biased toward the second closed position. Finally, there may be a coupler configured to engage the flow tube with the retainer sleeve.

Other aspects and advantages of the disclosure will be apparent from the following description and the appended claims.

DETAILED DESCRIPTION

Figure 2:
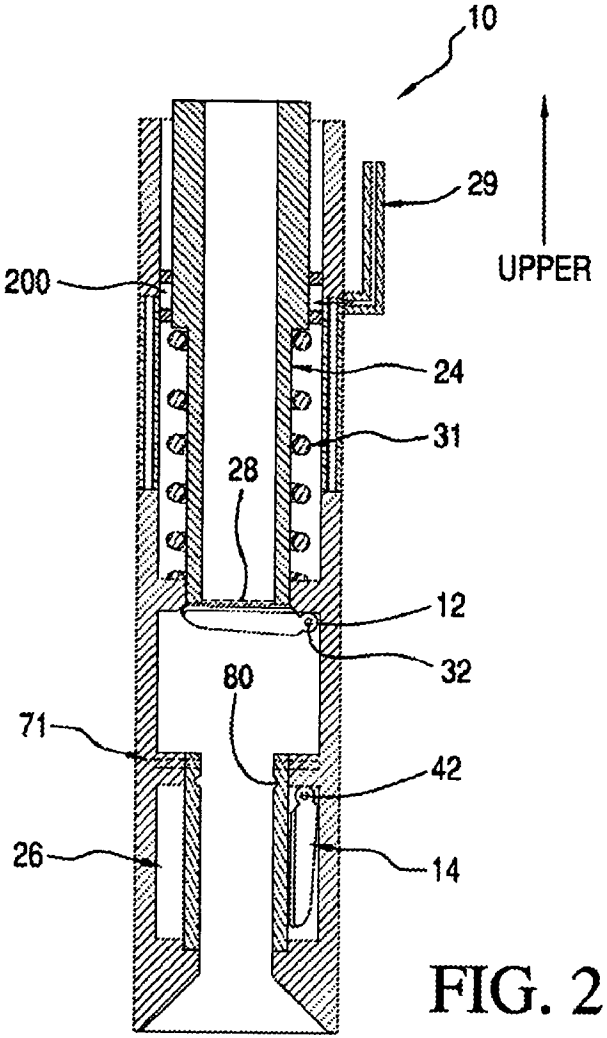
FIG. 2 shows the valve of FIG. 1 with the primary valve closed and the secondary valve concealed, in accordance with embodiments disclosed herein.

Specific embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the disclosure. However, it will be apparent to one of ordinary skill in the art that the embodiments disclosed herein may be practiced without these specific details. In other instances, well-known features have not been described in detail to avoid unnecessarily complicating the description.

In addition, directional terms, such as "above," "below," "upper," "lower," "front," "back," etc., are used for convenience in referring to the accompanying drawings. In general, "above," "upper," "upward," etc. refer to a direction toward the Earth's surface, but is meant for illustrative purposes only, and the terms are not meant to limit the disclosure.

Figure 1:
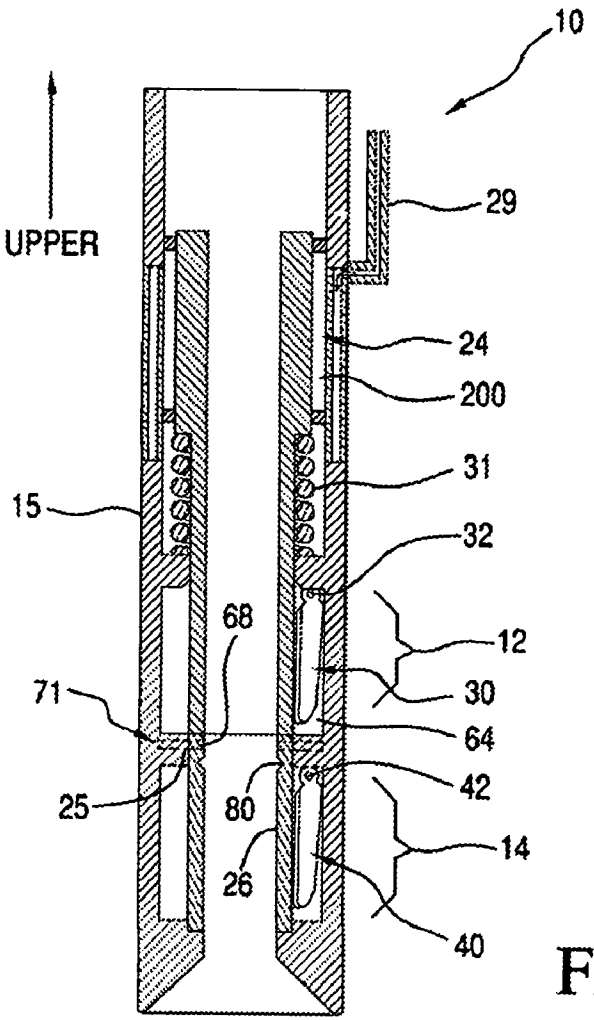
FIG. 1 shows one embodiment of the SCSSV assembly with the primary valve open and the secondary valve concealed, in accordance with embodiments disclosed herein.

FIGS. 1 and 2, especially, show the SCSSV assembly in its first operating mode, wherein primary valve 12 is in service and secondary valve 14 is out of service. Referring to the figures, especially FIG. 1, surface controlled subsurface safety valve ("SCSSV") assembly 10 comprises a housing 15, a primary valve 12 comprising an upper flapper 30, and a secondary valve 14 comprising a lower flapper 40. Both upper flapper 30 and lower flapper 40 are rotatably disposed within housing 15 by pivots 32 and 42, respectively. Springs 34 and 44 (best seen in FIG. 5) bias the upper and lower flappers, respectively, toward a closed position, i.e. a position blocking the bore of flow tube 24 or concealment sleeve 26, as the case may be. Flow tube 24 is slidably disposed within housing 15, and has a bore extending therethrough. Flow tube 24 is biased by spring 31 toward an upward direction, as shown in FIG. 2. When flow tube 24 is in its upward position, upper flapper 30 is rotated to a closed position, also as seen in FIG. 2, thereby stopping upward flow through the valve.

FIG. 1 shows the SCSSV assembly with the upper flapper 30 in an open position, with flow tube 24 moved to a downward position pushing upper flapper 30 to its open position. Flow tube 24 is moved downward by various means known in the art. In the presently preferred embodiment, the SCSSV assembly comprises a means for moving the flow tube downward, which may comprise hydraulic or electric means (operable from the surface) to move flow tube 24 downward, against the bias of spring 31, as in FIG. 1. One embodiment comprises a fluid chamber 200 within said valve assembly, operatively connected to said flow tube, a hydraulic line 29 connected to said valve assembly, and a supply of hydraulic fluid connected to said hydraulic line; this hydraulic means is well known in the art.

Figure 6:
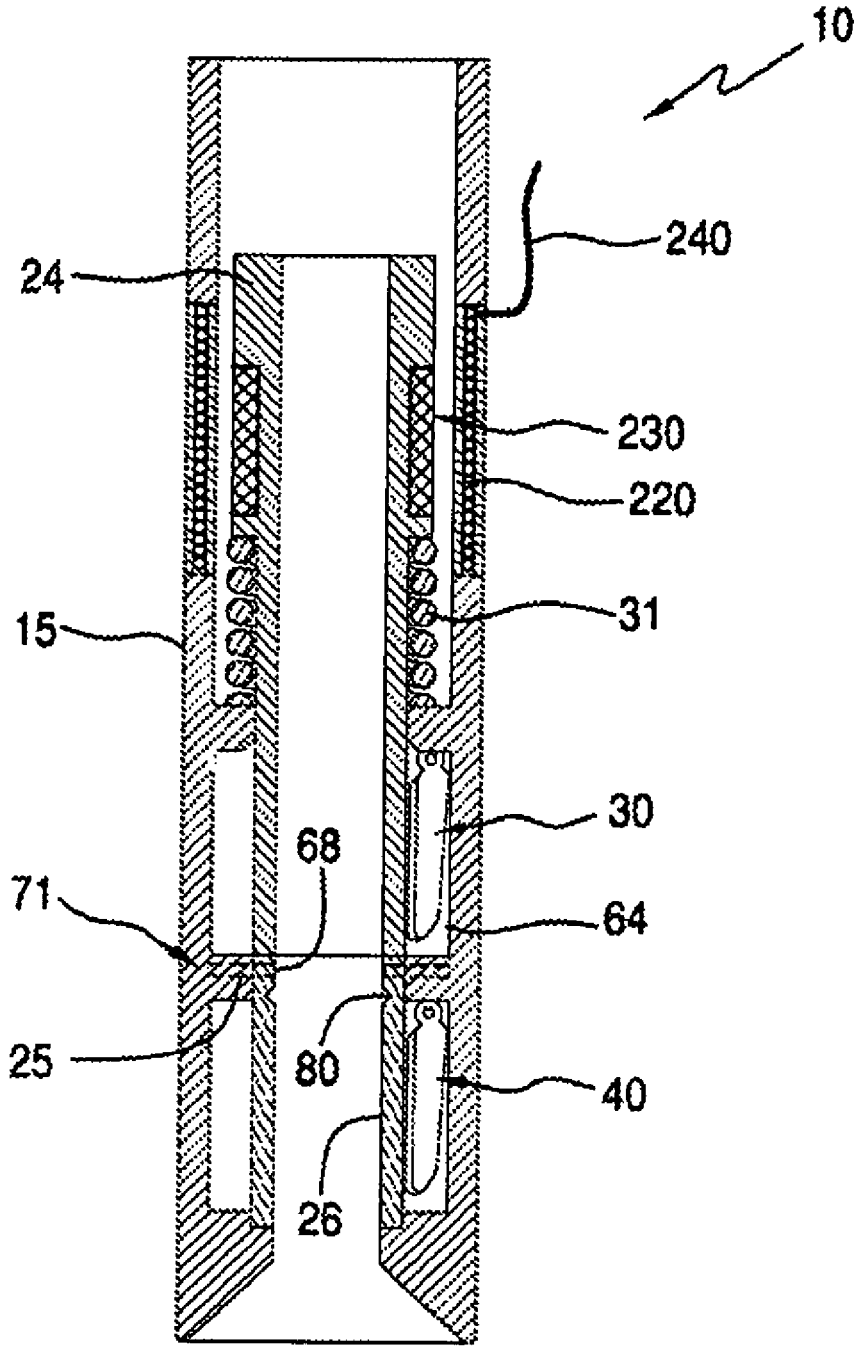
FIG. 6 shows the SCSSV having the flow tube moved by an electric solenoid and armature, in accordance with embodiments disclosed herein.

Yet another embodiment, shown in FIG. 6, of the means for moving flow tube 24 downward comprises a solenoid electrical coil 220 disposed in said outer housing, a magnetic armature 230 connected to said flow tube, and an electrical current source 240 connected to solenoid electrical coil 220. Preferably, a plurality of electrical coils 220 are provided, wired in series with one another, and would have an outer housing comprising a material which would focus the magnetic flux in the direction of armature 230.

Yet another embodiment comprises a fluid chamber 200, which is pressurized (effectively "pre-charged") before the apparatus is run into the wellbore. The fluid volume thus held within fluid chamber 200 provides the operating fluid to move flow tube 24 (as later described), and the fluid volume may be released by a mechanical means (e.g., wireline tool or other mechanical means), electric means (e.g. solenoid coil and armature), or hydraulic means (e.g. hydraulic signal sent to the tool via hydraulic line 29).

When moved downward, flow tube 24 biases upper flapper 30 to an open position and rotates flapper 30 into upper recess 64 of safety valve housing 15. Lower end 25 of flow tube 24 meets upper end 68 of concealment sleeve 26, thereby forming a continuous fluid flow path through the SCSSV assembly. In such position, normal flow of fluid through flow tube 24 may occur. In FIG. 2, it can be seen that lower flapper valve 40 remains rotated to an open position, positioned within lower recess 66 of housing 15. Concealment sleeve 26 remains in place across lower flapper 40, holding it open.

Referring to FIG. 2, upper primary valve 12 is depicted in a closed position in relation to outlet 28 of flow tube 24. Flow tube 24 has been moved upward by reducing pressure from hydraulic means 29 (or, in another embodiment, halting electric current flow to means 29), allowing spring 31 to push flow tube 24 upward. As earlier described, lower secondary valve 14 is depicted with flapper 40 open and retained in the open position by concealment sleeve 26. Concealment sleeve shear pins 71 are intact.

During operation, upper primary valve 12 may become compromised. Fluid may be able to flow past primary valve 12 into flow tube 24 even though primary valve 12 (namely, upper flapper 30) is in the closed position, as in FIG. 2. If primary valve 12 becomes compromised, utilization of secondary valve 14 is required.

Figure 4:
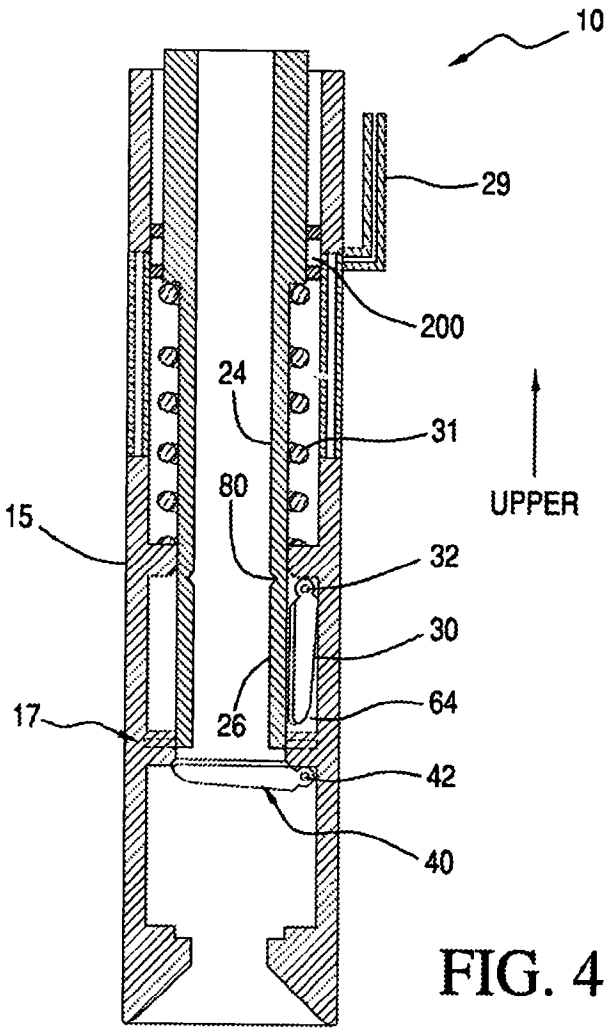
FIG. 4 shows the valve with the flow tube and the concealment sleeve connected, and with the connected tube and sleeve in an upward position, with the primary valve concealed and the secondary valve closed, in accordance with embodiments disclosed herein.
Figure 3:
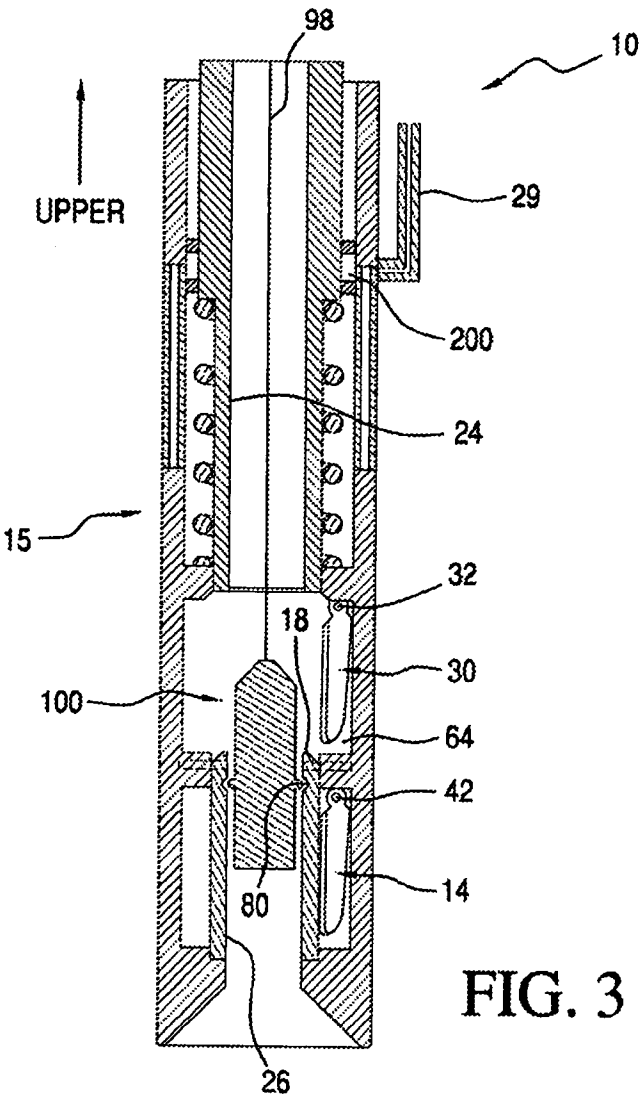
FIG. 3 shows the valve of FIG. 1 with a wireline deployed tool engaging the concealment sleeve preparatory to moving it into engagement with the flow tube, in accordance with embodiments disclosed herein.

Referring to FIGS. 3 and 4, one embodiment of shifting of the tool to the secondary valve, thereby placing same in the second operating mode, can be described. In this particular illustrated embodiment, the shifting is accomplished by means of a wireline-deployed shifting tool; however, it is understood that other means can be used to shift the tool.

Figure 5:
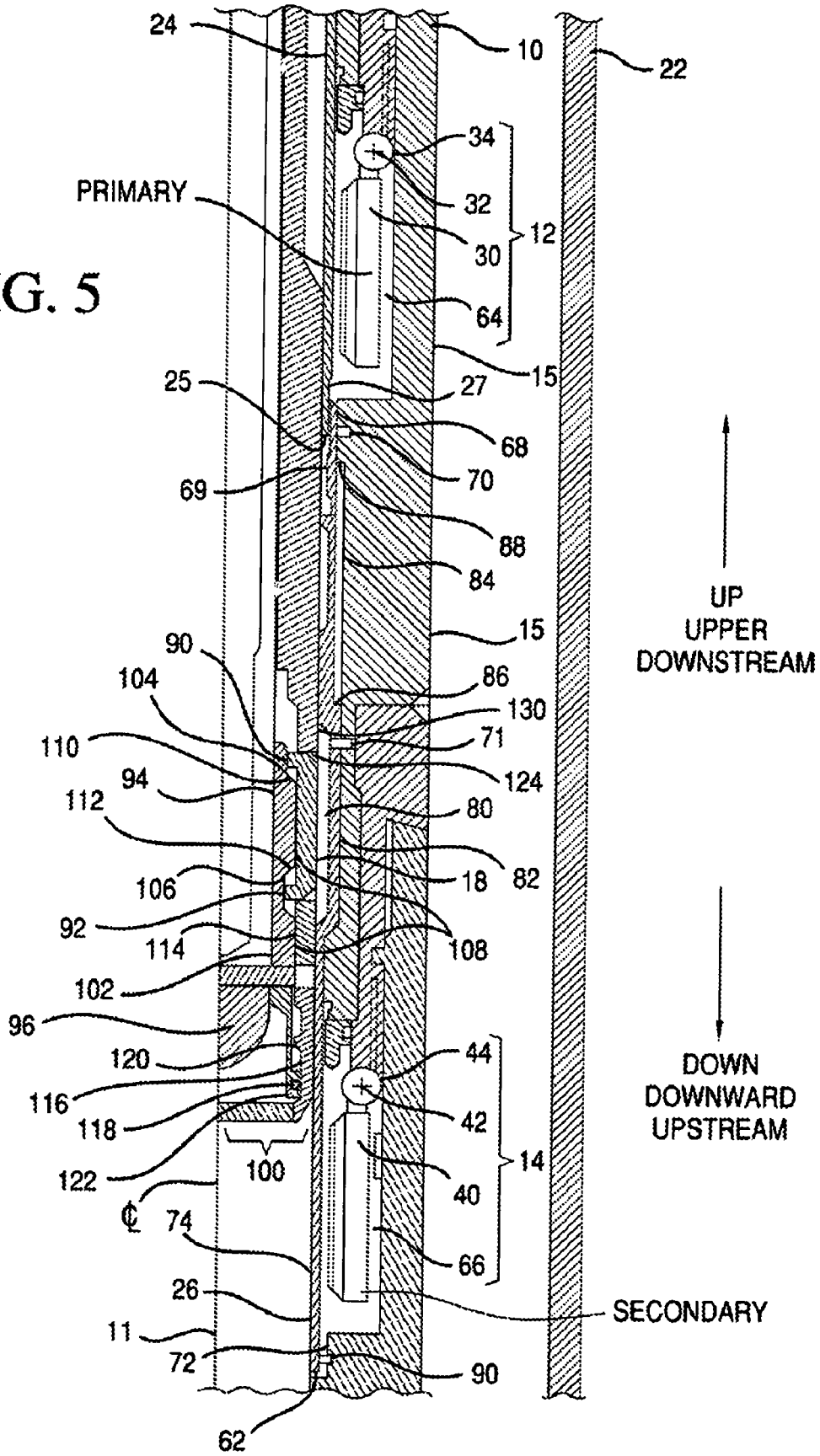
FIG. 5 shows a more detailed partial cross section view of the SCSSV, in accordance with embodiments disclosed herein.

In FIG. 3, shifting tool 100 is placed (see also FIG. 5) using wireline 98, except that FIG. 5 shows flow tube 24 extended downward and contacting concealment sleeve 26. Shifting tool 100 displaces upper flapper 30 into upper housing recess 64 of safety valve housing 15. Shifting tool 100 reaches an initial position when the no-go (not shown) contacts an upper surface of SCSSV 10. As is described in more detail below, in connection with FIG. 5, shifting tool 100 engages concealment sleeve 26, and pulls upward, shearing shear pins 71. Concealment sleeve 26 is moved upward by shifting tool 100 until it contacts and joins to flow tube 24. Concealment sleeve 26 and flow tube 24 are joined by a means for connecting said concealment sleeve and flow tube, said means for connecting including various means known in the art, including a collet, threads, etc. In the illustrated embodiment, opposing threading 69 on upper end 68 of concealment sleeve 26 engages opposing threading 27 on lower end 25 of flow tube 24 (best seen in FIG. 5), thereby connecting the two parts. Shifting tool 100 is removed from the production tubing.

Referring to FIG. 4, with flow tube 24 and concealment sleeve 26 joined (thereby forming a continuous tube), upper flapper 30 is thereafter retained in recess 64, and the primary valve 12 is out of service. With concealment sleeve 26 attached to flow tube 24, secondary valve 14 is in service, and is operable in the same manner as primary valve 12, until primary valve 12 was compromised. FIG. 4 shows flow tube 24 and concealment sleeve 26 in an upward position, thereby permitting lower flapper 40 to close under its spring bias (and where applicable, the force of flowing fluid, or fluid pressure from below, once closed). It can be readily understood that the open position for lower flapper 40 is substantially shown in FIG. 1 (wherein both the upper and lower flappers are rotated into their open positions). It can be further readily understood that FIG. 4 shows SCSSV assembly 10 in its second operating mode, with secondary valve 14 in service and primary valve 12 out of service.

The above-described embodiment had a single secondary valve 14 (that is, the illustrated embodiment has only two flappers—an upper and a lower flapper). Alternative embodiments may have more than one secondary valve 14 (and of course more than one additional flapper) with corresponding concealment sleeves 26 within SCSSV assembly 10. If the first secondary valve 14 is compromised, the second secondary valve 14 may be put into operation using the above-described method for the first secondary flapper valve 14. Likewise, additional secondary flapper valves 14 may be used.

In alternative embodiments, and as described above, flow tube 24 may be manipulated using hydraulic or electric force/pressure. Concealment sleeve 26 may be shifted into connection with flow tube 24 by non-wireline means, for example flow tube 24 may be forced into a downward position by hydraulic pressure such that it engages with and joins with concealment sleeve 26. For example, at an elevated value of hydraulic pressure applied through hydraulic line 29, such as 150% of normal hydraulic pressure, moves flow tube 24 downward with sufficient force to shear shear pins 71, and force flow tube 24 and concealment sleeve 26 together and connect them for example via a means for connecting as earlier described (such as opposed threads). This non-wireline means may be particularly important in subsea operations where wireline is not practical.

In another embodiment, lower flapper 40 comprises the primary valve, and upper flapper 30 comprises the secondary valve—effectively, the roles of valve 12 and valve 14 are reversed, with valve 14 becoming the primary (initially in service) valve and valve 12 becoming the secondary valve. In this embodiment, in the first operating mode, flow tube 24 and concealment sleeve 26 are initially connected, as in FIG. 4; therefore, lower flapper 40 is initially in service.

To move SCSSV assembly 10 to its second operating mode, a shifting tool, e.g. shifting tool 100, disconnects flow tube 24 and concealment sleeve 26, and moves concealment sleeve 26 to the position shown in FIG. 2, thereby taking lower flapper 40 and valve 14 out of service. Appropriate means, known in the art, such as a collet, detent, etc. are used to hold concealment sleeve 26 in place. Then, valve 12, namely flapper 30 is in service, with flapper 30 exposed as in FIGS. 1 and 2.

Referring to FIG. 5, more detail is shown of one embodiment of the SCSSV in a partial cross-sectional view of SCSSV 10 inside a casing string 22. Wireline shifting tool 100 is shown inside SCSSV 10. FIG. 5 shows SCSSV 10, casing string 22, and shifting tool 100, to a centerline 11. SCSSV 10, casing string 22, and shifting tool 100 are substantially symmetric about centerline 11. SCSSV 10 is shown with the components oriented as during production except that shifting tool 100 is not interior of SCSSV 10 during production. The interaction of shifting tool 100 with SCSSV is detailed below.

Casing string 22 surrounds SCSSV assembly 10. Casing string 22 extends from the producing reservoir of the well (not shown) to the wellhead (not shown) at a ground (or marine) surface. SCSSV assembly 10 is threadably inserted within the production string (not otherwise shown) and forms apart of the production string. The production string extends from at least a packer (not shown) to the wellhead (not shown). In accordance with embodiments disclosed herein, an additional portion of the production string is below SCSSV assembly 10. Casing string, production string and packer placement and operation are generally known in the industry and will not be detailed herein.

SCSSV assembly 10 includes a safety valve housing 15, a primary valve 12, a secondary valve 14, a concealment sleeve 26, and flow tube 24. Primary valve 12 comprises a flapper-type valve including an upper flapper 30, a pivot 32, and a spring 34 for biasing flapper 30 toward a closed position in relation to sleeve lower end 25 of concealment sleeve 26. Upper flapper 30 is fixedly and rotatably attached to safety valve housing 15 at pivot 32. In an open position as shown in FIG. 5, flapper 30 and pivot 32 are retained in upper recess 64 of safety valve housing 15.

Secondary valve 14 comprises a flapper-type valve including a lower flapper 40, a pivot 42, and spring 44 for biasing lower flapper 40 toward a closed position in relation to a sleeve lower end 62 of concealment sleeve 26. Lower flapper 40 is rotatably attached to safety valve housing 15 at pivot 42. In an open position as shown in FIG. 5, lower flapper 40 and pivot 42 are retained in lower recess 66 of safety valve housing 15.

Concealment sleeve 26 comprises a hollow cylindrical structure having variable inside diameter and outside diameter. Concealment sleeve 26 has an upper end 68 and opposing threading 69 proximate its upper end 68. Flow tube 24 has a lower end 25 and opposing threading 27 proximate its lower end 25. Opposing threading 69 and 27 provide a sealed connection, between concealment sleeve 26 and flow tube 24, when opposing threading 69 and 27 are engaged. A wiper ring (not shown) may also be used in conjunction with opposing threads 69 and 27. As shown in FIG. 5, upper end 68 of concealment sleeve 26 is slightly overlapping lower end 25 of flow tube 24 but opposing threads 69 and 27 are not engaged.

When opposing threads 69 and 27 are engaged, concealment sleeve 26 becomes an extension on flow tube 24. One or more shear pins 71 retain the position of concealment sleeve 26 relative to safety valve housing 15 and prevents threading 69 from engaging threading 27 until shear pin 71 is sheared (described below). Other attachment methods may be used to connect flow tube lower end 25 with sleeve upper end 69. Seals 70 are provided proximate sleeve upper end 68 and sleeve lower end 62 to provide sealing engagement between concealment sleeve 26 and safety housing 15.

Concealment sleeve 26 fits inside safety valve housing 15 and its lower open end slidably engages interior surface 72 of safety valve housing 15. Sleeve interior surface 74 includes a key opening 80 for receiving a key 18.

Sleeve 26 further comprises an expanded diameter segment 82 slidably receivable in a safety valve housing indent 84 of safety valve housing 15. A sleeve shoulder 86 is provided proximate the upper end of expanded diameter segment 82. An indent ledge 88 is provided proximate the upper end of safety valve housing indent 84. When concealment sleeve 26 is moved upwardly (shearing sheer pin 71) in relation to safety valve housing 15, sleeve shoulder 86 engages indent ledge 88 and blocks further upward movement of concealment sleeve 26 in relation to safety valve housing 15.

Wireline shifting tool 100 is provided for engaging a key 18 on shifting tool 100 with sleeve 26 to shift sleeve 26 from the position shown in FIG. 1 to a position where concealment sleeve 26 conceals flapper 30 and no longer conceals flapper 40. Shifting tool 100 includes, key 18, key base 94, and activator 114. The upper end of shifting tool 100 is connected to a "no-go" (not shown), which is connected to a rope socket (not shown), which in turn is connected to a wireline 98 (Shown in FIG. 4). Wireline 98 is a conventional wireline extending to the surface. Wireline 98 is operable from the surface, such operation including upward and downward movement, among other things.

In operation, wireline 98 is used to lower shifting tool 100 through the production string. The no-go contacts the upper end of shifting tool 100 and the wireline is unable to advance further down the production string. As a result, shifting tool 100 is positioned in the desired location within SCSSV assembly 10, as shown in FIG. 5.

Key 18 on shifting tool 100 comprises a solid member that may be partially cylindrical having an upper inward-extending rim 90 and a lower inward-extending rim 92. Multiple keys 18 may be located around the periphery of shifting tool 100. In one embodiment three keys 18 may be located at 120 degrees from each other around the periphery of shifting tool 100. Key 18 is slidably mounted on the exterior surface of a key base 94. Key base 94 is detachably mounted on a prong 96. Prong 96 is connected to the no-go.

Key base 94 is generally cylindrical having an exterior base surface 102. Exterior surface 102 has an upper base recess 104 and lower base recess 106. Upper base recess 104 and lower base recess 106 define an outer exterior base surface 108 intermediate the recesses 104 and 106. A corresponding outer exterior base surface 108 is defined below lower base recess 106. Upper inclined transition 110 extends between outer exterior base surface 108 and upper base recess 104. Lower inclined transition 112 extends between lower base recess 106 and outer exterior base surface 108.

Activator tube 114 comprises a generally cylindrical structure concentrically aligned with key base 94 and slidably arranged on key base 94. A tube recess 116 proximate the lower end of activator tube 114 is provided. A tube recess upper ledge 120 and a tube recess lower ledge 122 are defined at the upper and lower ends respectively of tube recess 116. An exterior rim 118 is provided proximate the lower end of key base 94. Exterior rim 118 is slidable within tube recess 116. Upper sliding movement of key base 94 with activator tube 114 is limited by engagement of exterior rim 118 with recess 116 upper ledge 120. Lower sliding movement of key base 94 with activator tube 114 is limited by engagement of exterior rim 118 with recess lower ledge 122.

An activator opening 124 is provided in activator tube 114. Activator opening is sized to receive at least a portion of key 18. Key 18 extends into activator opening 124. Activator 114 is slidably moveable in relation to key base 94. Key 18 is slidably moveable in relation to key base 94. Upward movement of key base 94 in relation to activator 114 results in travel of upper inward extending rim 90 and lower inward extending rim 92, of key 18 along the exterior surface 102 of key base 94.

Upon such movement upper inward extending rim 90 engages upper inclined transition 110 and lower inward extending rim 92 engages lower transition 112 causing key 18 to move outwardly in relation to key base 94 and to eventually rest on outer exterior base surface 108. Key 18 is thereby extended outwardly beyond the exterior surface 130 of activator tube 114 and into key opening 80 of concealment sleeve 26. Thereafter, continued upward movement of key base 114 results in upward movement of activator 114 and key 18. Because key 18 is engaged in concealment sleeve 26, concealment sleeve 26 also moves in the upward direction. The initial upward movement of concealment sleeve 26 causes shearing of shear pin 71. Upward movement of concealment sleeve 26 in relation to safety valve housing 15 continues until such movement is prevented by engagement of sleeve shoulder 86 with indent ledge 88.

Concealment sleeve 26 is sized and structured such that sleeve lower end 62 is positioned upward from secondary valve 14 at engagement of sleeve shoulder 86 with indent ledge 88. Accordingly, secondary valve 14 is operable to close sleeve lower end 62 in such position.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

I claim:

1. A valve assembly comprising:

a housing;

a primary valve movable between an open position and a closed position, wherein the primary valve is biased toward the closed position;

a secondary valve movable between an open position and a closed position, wherein the secondary valve is biased toward the closed position;

a flow tube slidably disposed in the housing, wherein the flow tube is movable between a first position in which the flow tube retains the primary valve in the open position, and a second position, wherein the flow tube is biased toward the second position;

a sleeve slidably disposed in the housing and independently movable relative to the flow tube, wherein the sleeve is movable between a first position in which the sleeve retains the secondary valve in the open position, and a second position;

a fluid chamber in fluid communication with the flow tube, wherein fluid in the fluid chamber prevents movement of the flow tube toward the second position; and a mechanical member, an electrically actuated member, a hydraulically actuated member, or combinations thereof, configured to release fluid from the fluid chamber, thereby permitting movement of the flow tube toward the second position.

2. The valve assembly of claim 1, wherein the primary valve comprises a primary flapper secured to the housing, wherein the secondary valve comprises a secondary flapper secured to the housing, and wherein the primary valve and the secondary valve restrict upwell flow and allow downwell flow through the valve assembly.

3. The valve assembly of claim 1, wherein the flow tube and the sleeve form a continuous flowpath through the valve assembly, wherein the flow tube fluidly isolates the primary valve from the continuous flowpath, and wherein the sleeve fluidly isolates the secondary valve from the continuous flowpath.

4. The valve assembly of claim 1, further comprising:

an activation mechanism configured to move the flow tube toward the first position, wherein the activation mechanism comprises:

a fluid chamber in fluid communication with the flow tube; and a hydraulic conduit in fluid communication with a fluid source and the fluid chamber.

5. The valve assembly of claim 1, further comprising:

an activation mechanism configured to move the flow tube toward the first position, wherein the activation mechanism comprises:

an electromagnetic coil disposed in the housing in electrical communication with an electrical current source; and a magnetic armature connected to the flow tube, wherein creation of a magnetic field by the electromagnetic coil causes movement of the flow tube toward the first position.

6. The valve assembly of claim 1, wherein the sleeve is attachable to the flow tube, and wherein the sleeve is movable between the first position and second position by moving the flow tube.

7. A method for restricting upwell flow in a wellbore, the method comprising the steps of:

providing a primary valve movable between an open position and a closed position, wherein the primary valve is biased toward the closed position;

providing a secondary valve movable between an open position and a closed position, wherein the secondary valve is biased toward the closed position; and selectively and independently retaining one of the primary valve and the secondary valve in the open position while permitting the other of the primary valve and the secondary valve to move toward the closed position, by:

retaining the primary valve in the open position using a flow tube slidably movable relative to the primary valve;

retaining the secondary valve in the open position using a sleeve slidably movable relative to the secondary valve and independently movable relative to the flow tube; and at least one of:

moving the flow tube to permit movement of the primary valve toward the closed position; and moving the sleeve or both the flow tube and the sleeve to permit movement of the secondary valve toward the closed position, wherein the step of moving the sleeve comprises moving the sleeve using a tool, thereby permitting movement of the secondary valve toward the closed position.

8. The method of claim 7, wherein the step of selectively and independently retaining one of the primary valve and the secondary valve in the open position while permitting the other of the primary valve and the secondary valve to move toward the closed position comprises:

retaining the primary valve in the open position using a flow tube slidably movable relative to the primary valve;

retaining the secondary valve in the open position using a sleeve slidably movable relative to the secondary valve and independently movable relative to the flow tube; and attaching the sleeve to the flow tube.

9. The method of claim 8, further comprising the step of moving the flow tube, thereby moving the sleeve attached thereto, wherein movement of the sleeve relative to the secondary valve permits movement of the secondary valve toward the closed position.

10. A valve assembly comprising:

a housing;

a primary valve movable between an open position and a closed position, wherein the primary valve is biased toward the closed position;

a secondary valve movable between an open position and a closed position, wherein the secondary valve is biased toward the closed position;

a flow tube slidably disposed in the housing, wherein the flow tube is movable between a first position in which the flow tube retains the primary valve in the open position and a second position in which the primary valve is movable toward the closed position, wherein the sleeve is movable between a first position in which the sleeve retains the secondary valve in the open position and a second position in which the secondary valve is movable toward the closed position, and wherein the flow tube is biased toward the second position;

a sleeve slidably disposed in the housing, wherein the sleeve is attachable to the flow tube to enable unitary movement therewith and separable from the flow tube to enable independent movement of the sleeve relative to the flow tube;

a fluid chamber in fluid communication with the flow tube, wherein fluid in the fluid chamber prevents movement of the flow tube toward the second position; and a mechanical member, an electrically actuated member, a hydraulically actuated member, or combinations thereof, configured to release fluid from the fluid chamber, thereby permitting movement of the flow tube toward the second position.

11. The valve assembly of claim 10, wherein the primary valve comprises a primary flapper secured to the housing, and wherein the secondary valve comprises a secondary flapper secured to the housing, wherein the primary valve and the secondary valve restrict upwell flow and allow downwell flow through the valve assembly.

12. The valve assembly of claim 10, wherein the flow tube and the sleeve form a continuous flowpath through the valve assembly, wherein the flow tube fluidly isolates the primary valve from the continuous flowpath, and wherein the sleeve fluidly isolates the secondary valve from the continuous flowpath.

13. The valve assembly of claim 10, further comprising:

an activation mechanism configured to move the flow tube toward the first position, wherein the activation mechanism comprises:

a fluid chamber in fluid communication with the flow tube, and a hydraulic conduit in fluid communication with a fluid source and the fluid chamber;

an electromagnetic coil disposed in the housing in electrical communication with an electrical current source, and a magnetic armature connected to the flow tube, wherein creation of a magnetic field by the electromagnetic coil causes movement of the flow tube toward the first position; or combinations thereof.

14. The valve assembly of claim 10, wherein the sleeve is attachable to the flow tube to enable unitary movement therewith, and wherein movement of the flow tube moves the sleeve attached thereto to permit movement of the secondary valve toward the closed position.

* * * * *